United States Patent [19]

Grasselli

[11] Patent Number: 4,807,321

[45] Date of Patent: Feb. 28, 1989

[54] AIR CLEANING SYSTEM

[76] Inventor: Giorgio Grasselli, Via A. Varisco, 1, 42020 Albinea, Reggio Emilia, Italy

[21] Appl. No.: 78,059

[22] Filed: Jul. 27, 1987

[30] Foreign Application Priority Data

Dec. 16, 1986 [IT] Italy ..... 46863 A/86

[51] Int. Cl.[4] ..... B08B 5/02

[52] U.S. Cl. ..... 15/312 R; 222/249; 91/224; 92/117 A; 15/318; 15/300 R; 15/405

[58] Field of Search ..... 222/249, 250; 91/222, 91/224, 422; 417/349; 15/312 R, 316 R, 318, 405, 300 R; 137/624.14, 119; 92/117 R, 117 A

[56] References Cited

U.S. PATENT DOCUMENTS

| | | | |
|---|---|---|---|
| 2,016,372 | 10/1935 | Jennings | 222/249 X |
| 2,327,942 | 8/1943 | Thoresen | 137/866 X |
| 3,168,013 | 2/1965 | Williamson | 92/117 R X |
| 3,254,571 | 6/1966 | Kuhn | 91/222 X |
| 3,390,616 | 7/1968 | Hammer | 91/224 X |
| 3,552,606 | 1/1971 | Kraft | 222/249 |
| 3,571,840 | 3/1971 | Gleaton | 15/312 R |
| 3,960,058 | 6/1976 | Berkelius | 91/224 |
| 4,003,219 | 1/1977 | Stull | 92/117 A X |

*Primary Examiner*—Harvey C. Hornsby
*Assistant Examiner*—K. L. O'Leary
*Attorney, Agent, or Firm*—James J. Ralabate

[57] ABSTRACT

This invention relates to a novel system for removing foreign particles from a machine part, and, more particularly, to a system for cleaning meat by-products from meat processing rollers or other equipment.

6 Claims, 2 Drawing Sheets

AIR CLEANING SYSTEM

BACKGROUND OF THE INVENTION

It is known to clean rollers and other meat-processing equipment by the use of mechanical means such as brushes, blades and the like. In certain types of meat-processing equipment where rollers with teeth or cavities are used, meat portions, including fat or bone particles, become lodged in the indentations of the rollers. When it is necessary to move the meat product such as the hide or skin, a gear-like roller with teeth along its entire tubular length is generally used. This type roller is not effective for gripping the skin and moving it during derinding or other processing steps. The roller, to remain effective with its intended biting action, and to remain sanitary, must be cleaned. One of the earliest methods of cleaning, and one used today, is positioning a brush along the entire peripheral portion of the roller, and when cleaning of the roller is desired, the brush is shifted in contact with the teeth-containing cylindrical surface of the roller. The bristles from the brush spring into the crevices or teeth depresions and flick the foreign meat substances out.

A second and more effective way to clean these rollers is by the use of air jets that because of their fluid pressure can enter these crevices and wash or blow away these unwanted particles. The method of the prior art presently used is to position a movable cylinder (or other device) adjacent the roller to be cleaned. The cylinder contains jets or nozzles through which air is impelled to contact the roller to be cleaned. The cylinder moves laterally along the entire outer portion or periphery of the teeth-containing roller in order to reach all external parts and crevices of the roller. By the use of gas or compressed air supplied from an air source, and axial movement of the cylinder and nozzles along the periphery of the roller, an effective cleaning method is utilized. In this type system, however, two separate and distinct air networks are used; one to induce the lateral movement of the cylinder back and forth along the periphery of the teeth-containing roller, and a second air network to feed and force the compressed air through the air nozzles used to clean. While this air jet method is effective, it has also been found to be expensive because of the high consumption of air through the use of these two air sources.

There is a need for a gas or an air jet cleaning system that is as effective as the prior used system but substantially less expensive.

SUMMARY OF THE INVENTION

It is therefore an object of this invention to provide an air jet cleaning system that is devoid of the above-noted disadvantages.

Another object of this invention is to provide an air jet cleaning system having a single air inlet system to both impel the cylinder along its path and to supply air for the outlet nozzles.

Still a further object of the invention is to provide a novel less expensive air jet system for cleaning meat-processing equipment.

Yet a further object of this invention is to provide an efficient inexpensive air jet cleaning system for meat processing and other type equipment.

Still another object of this invention is to provide an air jet system which is very reliable and with one source of air that both moves the cylinder and nozzles and feeds the nozzles air for cleaning.

These and other objects are provided by the novel cleaning system of this invention which comprises an air movable cylinder having at least one nozzle attached thereto. The cylinder and nozzles have the same and identical source of air and share the same air inlet-feed. Thus, a substantial savings in compressed air costs is provided by the novel system of this invention.

DETAILED DESCRIPTION OF THE DRAWINGS AND PREFERRED EMBODIMENTS

Figure 1:
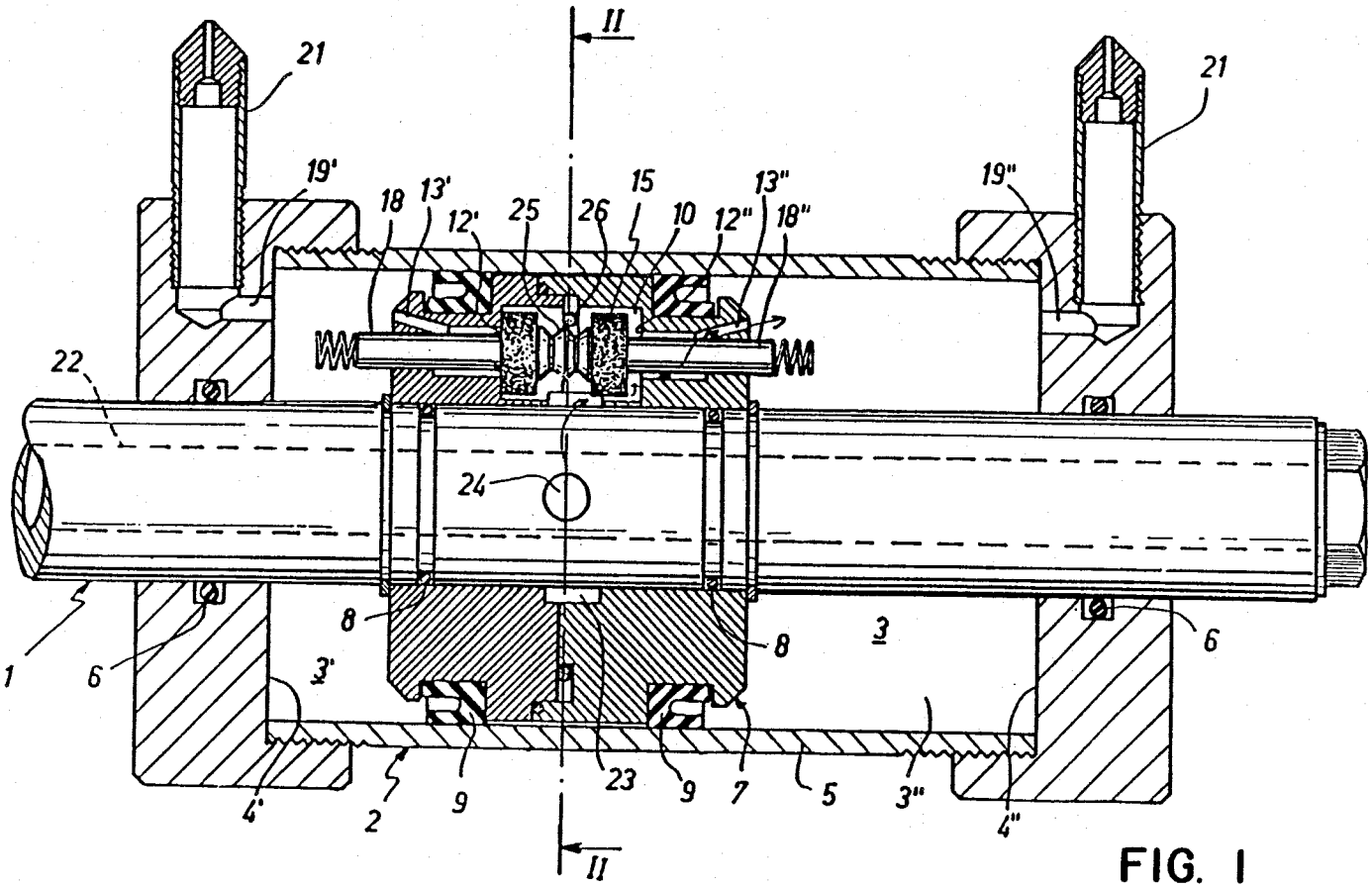
FIG. 1 shows a detailed sectional side view of the roller to be cleaned and the cleaning cylinder with nozzles on an axial plane.
Figure 3:
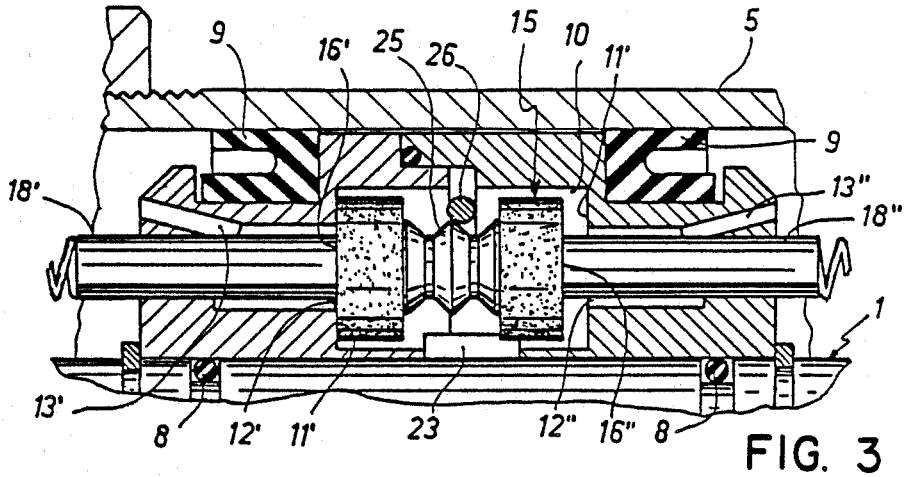
FIG. 3 shows a FIG. 1 enlarged sectional view of the air intake portion of the cylinder of this invention.
Figure 4:
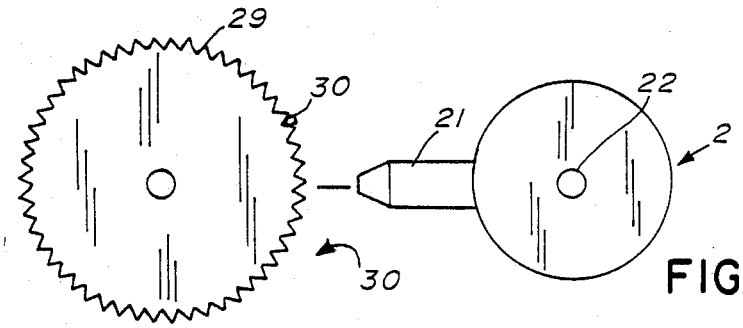
FIG. 4 is a plan view of the teeth-containing roller to be cleaned and adjacent it the cylinder of this invention.

Referring to above-mentioned FIGS. 1 and 3, inside movable cylinder 2 is located a fixed cylinder 1. Movable cylinder 2 moves back and forth as chamber 3 fills on one side (3 or 3[1]) with gas. (By "gas" throughout this disclosure is included compound air, gas, steam and the like.) Cylinder chamber 3 has a straight and circular section comprising two opposite and smooth lateral walls, respectively a wall 4' at left side and one 4" rightside, and a cylindrical surface 5. The cylindrical chamber 3 is axially crossed by a fixed body 1 upon which cylinder 2 slides back and forth. There are provided some proper gaskets that supply oil seal among body 1 and walls 4' and 4".

A piston is coaxially inserted on body 1, and it is locked to it and oil seal is guaranteed by gaskets 8. Piston 7 remains fixed but upon which cylinder 2 slides and includes chamber 3 which is divided into two isolated portions between themselves, at left side 3' and at rightside 3"; some proper gaskets 9 provide oil seal between piston 7 and cylindrical surface 5.

In the body of piston 7, a smaller size cylindrical chamber 10 is located whose axis is parallel to body 1 axis. The smaller chamber 10 comprises two opposite lateral walls 11' leftside and 11" rightside (as shown in FIG. 3) in each wall a respective conduit or hole is obtained, either leftside 12' or rightside 12', which is in touch through a pipe 13' with chamber portion 3' and respectively through pipe 13' with chamber portion 3". Thus, air is permitted to pass from chamber 10 through the conduit 12 in walls 11' and 11" through conduit 13 and into chambers 3 and 3'.

Inside smaller chamber 10, an axially moving mean obturator, including the two obturator surfaces, is located 16' at leftside and 16" at rightside, laterally located, whose reciprocal distance is smaller than the reciprocal one between holes 12' and 12". When obturator means 15 is displaced leftside, the surface 16' only blocks left hole 12' and alternatively when obturator means 15 is displaced rightside, the surface 16" only blocks right hole 12". Thereby gas will fill chamber 10 travel out conduits 12" and 13" to fill chamber 3 and push or move cylinder 2 to the left until spring 27' hits wall 28' and causes axel 18 to plug holes 12" and 13" and allow gas then to flow to now open ports or holes 12' and 13" to fill chamber 3' and push cylinder 2 to the right until spring 27 hits wall 28 and again causes left obturator means 15 to block holes 12' and 13' and cause cylinder 2 to again move to the left. This process continues causing cylinder 2 to move back and forth moving nozzles 21 along the entire lateral surface of contact tooth roller 29 to clean same.

A couple of cylindrical axels 18' and 18'' is locked to both left and right obturator means; they protrude from opposite lateral surfaces of piston body in chamber portion 3' and respectively in chamber portion 3'' enough to move the obturator means 15 from leftside to rightside and vice versa when said traces get in touch with lateral walls 4' and 4''. Inside body 2 two lateral walls, two apertures 19' and 19'' are provided; they are both in touch with a part of chamber 3 and 3' and their role is to discharge gas outside through nozzles 21. On body 2, a couple of nozzles 21 are located on opposite ends suitable to eject gas; they are both in touch with a respective gas conduit 19' and 19''. Gas at all times is discharged from nozzles 21 during the back and forth movement of cylinder 2. Body 1 is provided with an axial pipe 22 connected at a raised gas source (not shown in figures) being in touch with smaller chamber 10 by an annular conduit 23, which is obtained in piston body 7 which wraps body 1 and debouchs in smaller chamber 10 in an intermediate position between said holes 12' and 12''; pipe 22 is in touch with pipe 23 through one or more radial holes. Thus, gas feeds through inlet 23 and aperture 24 and eventually into chambers 10 and 3' and 3'' to cause cylinder 2 to move back and forth.

Obturator means 15 comprises in intermediate position between said obturator surfaces 16' and 16'' (see FIG. 3) a median portion whose shape is double frustum of a cone with largest base in common and orthogonal with smaller chamber axis 10; in advance it is provided with an elastic finger 26 which is located in seat obtained in piston body 7, coaxial with chamber 3 and located on median plane of smaller chamber 10, which finger elastically pushes on said median portion 26 in manner to let the two position of obturator means be steady against two holes 12' or 12''.

Figure 2:
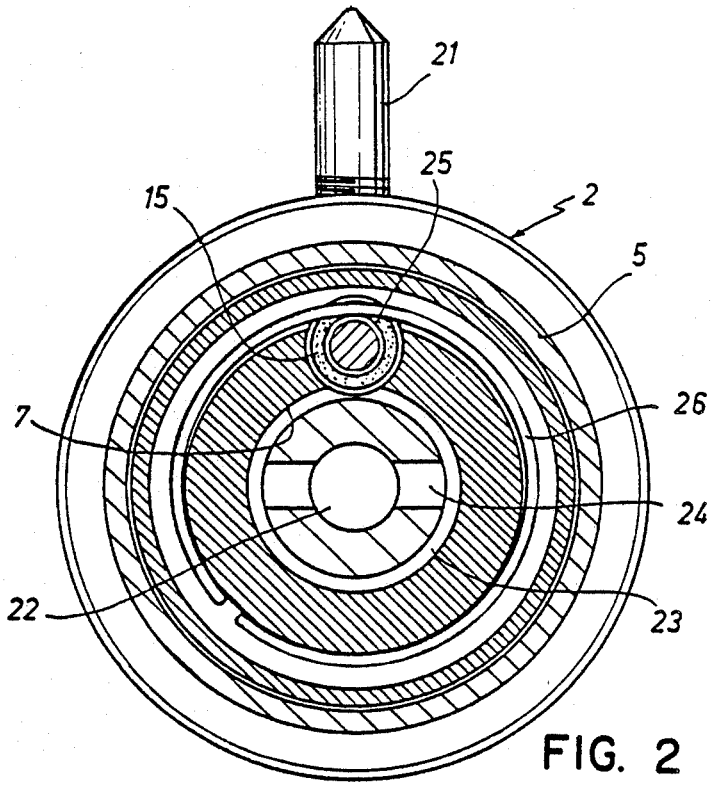
FIG. 2 shows a front plane section taken along lines II—II of FIG. 1.

The device functions as follows: Suppose initially that the device is located as shown in FIGS. 1–3 where obturator means 15 is displaced leftside and blocks hole 12' by surface 16'; the elastic finger pushes against the frustum of cone located at rightside and hence it pushes the obturator means towards leftside by allowing the means itself to be in a steady position. The raised gas or steam fluid, travelling in pipe 22, from here through hole 24 and after through conduit 23 enters in smaller chamber 10. Here hole 12' being blocked by left obturator means 15 while hole 12'' on the opposite side is open, the gas runs through hole 12'' and conduit or pipe 13'' and fills chamber portion 3'' on the right and through aperture 19'' and out through right nozzle 21. Meantime, residual gas is being pushed out left nozzle 21 as the rapid back and forth motion of cylinder 2 continues. As cylinder 2 moves back and forth its interior walls 28 and 28' hit springs 27, and 27' and bounces back in the opposite direction.

The gas is filling right chamber 3'' and at least in part of right of smaller chamber 10, and hence it (gas) pushes obturator means to the left blocking left hole 12'; said position is kept steady by elastic finger 26 which constantly pushes against means 25.

Chamber portion 3'', being filled with gas, enlarges its volume and thus the movable body 2 is pushed towards rightside on body 1. This displacement pushes or moves left trace 18' to stroke end, and hits left wall 4' with spring 27' and hence it pushes obturator means 15 in smaller chamber 10 to the right side to surface 16'', and it (displacement) opens opposite hole 12' and blocks hole 12''. This action snaps elastic finger 26 action over the point on means 25 and brings itself against the other frustum of cone 25 thereby pushing means 15 towards rightside and keeping it steady in this position. Since this moment gas which enters in chamber 10 runs successively in chamber 10 left portion giving moving cylinder or body 2 displacement towards rightside of body 1.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. An automatic gas-moved cleaning device comprising a source of gas, a movable first cylindrical means (2) laterally movable upon a second cylindrical means (1), said first cylindrical means containing a fixed body (7) having adjacent its opposite sides gastight chambers (3) and (3'), said chambers adapted to be alternately expanded and contracted with entrance of gas therein, when one of said chambers expands as filled with gas the other chamber adapted to be reduced in volume, said first cylindrical means (2) adapted to be continuously moved laterally along said second cylindrical means (1) as gas fills each chamber alternately, at least one nozzle (21) in gas flow relation with each of said chambers and adapted to permit gas to continuously flow out said nozzles from the interior of each of said chambers, said body (7) comprising means to direct gas flow alternately into each chamber and thereby cause first cylinder means (2) to move laterally back and forth and wherein the same source of gas is used to provide gas jets exiting said nozzles (21) and to provide movement of first cylindrical means (2) back and forth along the lateral periphery of a roller (29) to be cleaned.

2. The cleaning device of claim 1 wherein said body (7) comprises means that will move horizontally to alternately block and open conduits that are adapted to permit gas to enter one of said chambers.

3. The cleaning device of claim 1 wherein gas enters said device through a conduit located in said second cylindrical means (1) and means in said body (7) to direct said gas into either of said chambers.

4. The cleaning device of claim 5 wherein said body (7) comprises means that will move horizontally to alternately block and open conduits that are adapted to permit gas to enter one of said chambers.

5. An automatic gas-moved cleaning device comprising a source of gas, a first movable cylindrical means (2) and a second cylindrical means (1), said source of gas being the only means providing gas to the device and adapted to both move said first movable cylindrical means and provide gas jets exiting said device, said first cylindrical means containing a fixed body (7) having immediately adjacent its right and left sides substantially gastight chambers (3) and (3'), said chambers adapted to receive said gas in an alternate manner thereby moving said movable cylindrical means in a direction opposite to either the right and left side as it is filled with gas means whereby when one of said chambers expands as it fills with gas the other chamber is adapted to be reduced by movement of said movable cylindrical means, at least one outlet nozzle (21) in gas flow connection with each of said chambers and adapted to permit gas to continuously flow out said nozzles in a jet stream of sufficient force to permit cleaning of an adjacent device (29) said body (7) comprising means to direct gas flow alternately into each chamber and thereby cause said first cylindrical means (2) to continuously move laterally from right to left and subsequently left to right and wherein the same source of gas is used to provide gas jets exiting said nozzles and to provide movement of first cylindrical means (2) back and forth along the lateral periphery of a roller (29) to be cleaned.

6. The cleaning device of claim 5 wherein gas enters said device through a conduit located in said second cylindrical means (1) and means in said body (7) to direct said gas into either of said chambers.

* * * * *